United States Patent [19]

Vacca et al.

[11] Patent Number: 4,659,647

[45] Date of Patent: Apr. 21, 1987

[54] PHOTOSENSITIVE SILVER HALIDE MATERIAL FOR OBTAINING HALF-TONE BLACK-AND-WHITE IMAGES AND METHOD FOR HALF-TONE HIGH-CONTRAST REPRODUCTION

[75] Inventors: Alberto Vacca, Carcare/Savona; Angelo Vallarino, Spotorno/Savona, both of Italy

[73] Assignee: Minnesota Mining and Manufacturing Company, St. Paul, Minn.

[21] Appl. No.: 807,285

[22] Filed: Dec. 10, 1985

[30] Foreign Application Priority Data

Dec. 17, 1984 [IT] Italy ..... 24093 A/84

[51] Int. Cl.[4] ..... G03C 1/06

[52] U.S. Cl. ..... 430/264; 430/265; 430/267; 430/614; 430/615; 430/564; 430/567; 430/568; 430/949

[58] Field of Search ..... 430/264, 265, 614, 615, 430/949, 631, 568, 267, 567, 564

[56] References Cited

U.S. PATENT DOCUMENTS

| | | | |
|---|---|---|---|
| 3,082,088 | 3/1963 | Heilmann et al. | 430/614 |
| 3,462,272 | 8/1969 | Duffin et al. | 430/615 |
| 3,563,755 | 2/1971 | Anderson et al. | 430/615 |
| 3,565,631 | 2/1971 | Oguchi et al. | 430/615 |
| 3,765,900 | 10/1973 | Depoorter et al. | 430/949 |
| 4,551,412 | 11/1985 | Ogawa et al. | 430/264 |
| 4,560,638 | 12/1985 | Loblaw et al. | 430/264 |

*Primary Examiner*—Won H. Louie

*Attorney, Agent, or Firm*—Donald M. Sell; James A. Smith; Mark A. Litman

[57] ABSTRACT

A photosensitive silver halide material for obtaining black and white half-tone dot or line images comprises a fine grain and high-chloride silver halide emulsion reactively associated with an aqueous latex of a hydrophobic vinyl addition polymer in combination with a stabilizer selected from the group consisting of 4-hydroxy-1,3,3a,7-tetrazaindenes, benzotriazoles and benzimidazoles. The silver halide emulsion has an average grain size lower than or equal to 0.20 micron with at least 60% of its molar halide content consisting of chloride ions.

The material allows high-contrast and high resolving power images to be obtained.

The material has a good developability in photographic processings and this reduces the development times and increases productivity.

12 Claims, No Drawings

PHOTOSENSITIVE SILVER HALIDE MATERIAL FOR OBTAINING HALF-TONE BLACK-AND-WHITE IMAGES AND METHOD FOR HALF-TONE HIGH-CONTRAST REPRODUCTION

FIELD OF THE INVENTION

The present invention refers to a photosensitive silver halide material for obtaining black-and-white half-tone, dot or lines, images and to a method for the half-tone high contrast reproduction.

STATE OF THE ART

Photosensitive silver halide materials are commonly used in photolithographic industry to obtain half-tone, dot or line, high contrast images.

To increase the contrast necessary to lithographic prints, it is common practice to dope the silver halide emulsions with contrast-promoting agents, among which the most known are the water-soluble trivalent rhodium salts. It has been verified that good results as regards high covering power (which is the ratio between the maximum density obtained after development and the silver halide coverage) and good developability (reduction of the development times and increase in productivity) can be obtained by using fine-grain and high chloride content silver halide emulsions. It has been verified also that such emulsions do not obtain the necessary high contrast even if reactively associated with contrast-promoting agents known in photography, such as, for example, the above mentioned rhodium salts.

SUMMARY OF THE INVENTION

A method has been found to increase contrast in a silver halide photosensitive material used to obtain black and white half-tone, dot or line images, wherein an image-wise exposed fine-grain and high chloride content silver halide emulsion is subjected, after exposure, to a photographic processing comprising an alkaline developing solution, said method consisting of reactively associating the fine-grain and high chloride content silver halide emulsion with an aqueous latex of a hydrophobic vinyl addition polymer in combination with a stabilizer selected from the group consisting of 4-hydroxy-1,3,3a,7-tetrazaindenes, benzotriazoles and benzimidazoles.

DETAILED DESCRIPTION OF THE INVENTION

The present invention relates to a photosensitive silver halide material to obtain black-and-white half-tone, dot or line, images comprising, coated on a support, one or more hydrophilic colloidal layers, characterized by the fact that at least one of them includes a fine-grain and high chloride content silver halide emulsion reactively associated with an aqueous latex of a hydrophobic vinyl addition polymer in combination with a stabilizer selected from the group consisting of 4-hydroxy-1,3,3a,7-tetrazaindenes, benzotriazoles and benzimidazoles. The term "fine-grain", as used in the present invention, is intended to refer to a silver halide having an average grain size equal to or lower than 0.20 micron. The term "high chloride content" or "high chloride" emulsion, as used in the present invention, is intended to refer to a silver halide emulsion having at least 60% of its halide molar content consisting of chloride ions. The term "stabilizer" relates to those compounds, known in the art, which are added to the photosensitive silver halide materials to retard or stop the changes occurring during ageing of said materials (generally the changes observed with increasing of storage of the materials are increase of fog and decrease of sensitivity and contrast).

The aqueous latexes which are used in the practice of the present invention essentially consist of water as a continuous phase and of particles of a hydrophobic vinyl addition polymer as a dispersed phase. The hydrophobic vinyl addition polymer comprises repeating units deriving from one or a mixture in any proportion of the following monomer classes:

(a) Ethene type monomers of formula:

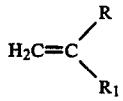

(I)

wherein R is hydrogen, halogen or vinyl and $R_1$ is hydrogen, halogen or methyl or, when R is hydrogen, is a cyano group. Specific examples of monomers repesented by formula (I) are isoprene, chloroprene, 1,3-butadiene, propenenitrile, vinylchloride, vinylfluoride, vinylidenechloride, vinylidenefluoride, ethylene, propylene, and the like.

(b) Styrene type monomers of formula:

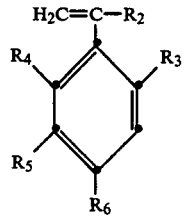

(II)

wherein $R_2$ is hydrogen or methyl; $R_3$, $R_4$ and $R_6$ are hydrogen or a low alkyl group having from 1 to 5 carbon atoms; $R_5$ is hydrogen or, with $R_4$, forms the atoms necessary to complete a fused benzene ring and one of $R_5$ and $R_6$ is halomethyl. Specific examples of monomers represented by formula (II) are styrene, o-vinyltoluene, p-vinyltoluene, p-chloromethylstyrene, m-choromethylstyrene, α-methylstyrene, 2-ethylstyrene, 4-butylstyrene, 4-pentylstyrene, 2-vinylmethylstyrene and 1-vinylnaphthalene.

(c) Monomers of the 2-alkenoic acid ester type of formula:

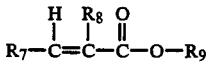

(III)

wherein $R_7$ is hydrogen or a low alkyl group having from 1 to 5 carbon atoms; $R_8$ is hydrogen, chlorine or a low alkyl group having from 1 to 5 carbon atoms and $R_9$ is an alkyl or a halogenalkyl group having from 1 to 20 carbon atoms. In the preferred form, $R_7$ is hydrogen and $R_8$ is hydrogen or methyl, such that the esters are formed from acrylic or methacrylic acid. In such preferred form, $R_9$ contains from 1 to 5 carbon atoms. The preferred 2-alkenoic acid esters are therefore acrylic or methacrylic acid low alkyl-esters, such as acrylic or methacrylic acid methyl, ethyl, propyl, iso-propyl, butyl, iso-butyl, tert.-butyl, pentyl, neo-pentyl esters or the like. The use of other 2-alkenoic acid esters is also foreseen, as specifically shown by formula (III). Further to the acrylic or methacrylic acid esters, α-ethylacrylic, α-propylacrylic, α-butylacrylic, α-pentylacrylic, 2-butanoic, 2-methyl-2-butanoic, 2-hexenoic, 2-octenoic, 2-methyl-2-octenoic acid esters can also be used. Further to the low-alkyl esters, hexyl, heptyl, octyl, undecyl, dodecyl, tetradecyl, hexadecyl, octadecyl, eicosyl esters and branched-chain isomers of the above mentioned 2-alkenoic acids can be used.

(d) Vinyl acetate.

The repeating units of the above-mentioned monomer classes form at least 60% by weight of the vinyl addition polymer and more preferably form the whole polymer. The remaining part of the polymer can be formed by repeating units deriving from other monomer classes which shall not modify the polymer properties, such as the hydrophobicity and compatibility thereof with the hydrophilic colloid of the layer.

The aqueous latexes are characterized by the fact that the polymer particles are highly dispersed. The polymer particles have a mean diameter ranging from 0.02 to 0.1 micron, preferably from 0.02 to 0.08 micron. The polymer particles form at least 2% by weight of the aqueous latex, preferably at least 10% and more preferably 20%.

The processes to obtain the aqueous latexes useful in the present invention are those well-known in the art of the polymer chemistry. The aqueous latexes can be produced, for instance, by using the conventional free-radical polymerization techniques to form organic polymer hydrosols. According to the most typical process, the aqueous latex containing the polymer particles distributed in the latex can be formed by charging in water the monomer or monomers necessary to form the desired polymer together with smaller quantities of ingredients, such as the polymerization initiators, surfactants to disperse the monomers, etc. In the case of co-polymers, the proportion with which the monomers are used is the one which approximately determines the proportions of the repeating units in the resulting polymer. A proper control of the proportions of the repeating units in the resulting co-polymers can be achieved by taking into consideration the differences (known in the literature) in the polymerization rate of the monomers (copolymerization constants). The proportions of the repeating units in the polymers of the present invention can be considered substantially those of the monomers introduced for the polymerization, since the proportion differences caused by this variance are not important to the purposes of the present invention. After the polymerization, the desired aqueous latex is formed with the polymer particles dispersed in the continuous aqueous phase. Examples of the free-radical polymerization technique which can be used to form aqueous latexes are those described in U.S. Pat. Nos. 2,914,499; 3,033,833; 3,574,899 and in CA Pat. No. 704,778.

Illustrative examples of aqueous latexes containing polymer or copolymer particles useful in the practice of the present invention are given below. The proportions of the monomers reacted to form the copolymers are given in terms of relative proportions of the monomers when they are introduced into the polymerization tank. The proportions of the continuous phase, which consists essentially of water, can be any within the preferred interval which ranges from 80 to 90% by weight. Wider variations of the continuous phase anyhow have few noticeable effects on the results obtained to the purposes of the present invention.

PL-1 Poly-(ethylacrylate) (100)
PL-2 Poly-(butylacrylate) (100)
PL-3 Poly-(ethylacrylate-co-methylmethacrylate) (70/30)
PL-4 Poly-(methylmethacrylate) (100)
PL-5 Poly-(ethylacrylate-co-methylmethacrylate) (30/70)
PL-6 Poly-(ethylacrylate-co-methylmethacrylate) (50/50)
PL-7 Poly-(ethylmethacrylate) (100)
PL-8 Poly-(styrene) (100).

The ratios shown between parenthesis are the ratios by weight of the repeating units corresponding to the order with which they have been mentioned. The 4-hydroxy-1,3,3a,7-tetrazaindenes, the benzotriazoles and benzimidazoles useful to the purposes of the present invention comprise unsubstituted 4-hydroxy-1,3,3a,7-tetrazaindene, benzotriazole and benzimidazole and their derivatives characterized by the substituents chosen among those of reasonable size and nature such as not to harm their characteristics useful to the purposes of the present invention. The size and nature of the substituents are in fact close to those of the compounds normally used with the emulsions of the art as stabilizers. For instance, with respect to the size, substituents, when comprising carbon chains and/or rings, should have no more than 10 carbon atoms, preferably no more than 5 carbon atoms. With respect to their nature, substituents such as nitro, hydroxy, halogen atoms, sulfo, cyano, amido, amino, alkyl, hydroxyalkyl, alkylthio, mercapto, carboxy, carboalkoxy, nitroamino and aromatic groups can be used to the purposes of the present invention. The skilled in the art, who knows very well how to select substituents of these compounds for their use as stabilizers in conventional emulsions, will be able to select them to combine with the fine grain high chloride emulsions of the present invention depending upon the desired effects.

In particular, the 4-hydroxy-1,3,3a,7-tetrazaindenes of the present invention can correspond to the general formulas:

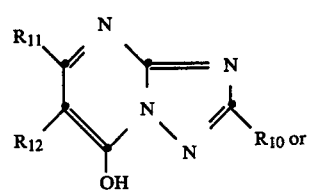

(IV)

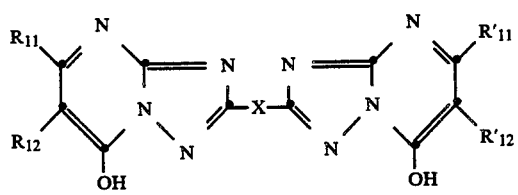

(V)

wherein $R_{10}$ is hydrogen, a low alkyl group such as, for instance, methyl, ethyl, propyl, isopropyl, butyl, isobutyl, etc. (i.e. an alkyl group containing from 1 to 5 carbon atoms), a substituted alkyl group such as, for instance, hydroxyalkyl, halogen-alkyl, etc., an aryl group such as, for instance, phenyl, o-, m- or p-tolyl, etc., an alkylthio group such as, for instance, methylthio, ethylthio, etc., an amino group such as, for instance, amino, methylamino, pyperidino, morpholino, etc., a mercapto group, a carboxy group, a carboalkoxy group such as, for instance, carbomethoxy, carboethoxy, carbobutoxy, etc. or a nitroamino group; $R_{11}$ and $R'_{11}$ are each hydrogen, a low alkyl group, an aryl group or an alkylthio group as described above for $R_{10}$; $R_{12}$ and $R'_{12}$ are each hydrogen, a low alkyl group, a substituted alkyl group, an amino group, an aryl group, a carboxy group, a carboalkoxy group as described above for $R_{10}$, a halogen or a cyano group; or $R_{11}$ and $R_{12}$ and/or $R'_{11}$ and $R'_{12}$ are part of an alicyclic or heterocyclic 5- or 6-membered ring; and X is an organic divalent group containing at least two carbon atoms such as, for instance, ethylene, propylene, tetramethylene, etc., including those divalent groups which have substituents as halogen atoms, hydroxy, carboxy groups, etc. or which may have carbon atoms of the alkylene chain partially substituted with other atoms such as oxygen, nitrogen, etc. The alkyl substituents above, substituted or not substituted, are low alkyl groups, preferably having a carbon atom number ranging from 1 to 5. Examples of 4-hydroxy-1,3,3a,7-tetrazaindenes, corresponding to the formula (IV), are 6-methyl-; 2,6-dimethyl-; 6-hydroxy-; 6-amino-; 6-carbethoxy-; 6-(β-pyridyl)-; 2-cyclohexyl-6-methyl-; 2-(α-furyl)-6-methyl-; 6-methyl-5-hexyl-; 5,6-cyclopenthane-; 5,6-cyclohexane-; 6-methyl-2-carboxy-; 5-ethyl-2-carboxy-; 6-ethyl-2-carbethoxy-; 5-(2-pyridyl)-2-carboxy-; 5-chloro-6-methyl-; 2,6-dimethyl-5-bromo-; 5-iodo-6-methyl-; 2-amino-6-methyl-; 6-hydroxy-2-amino-; 6-benzyl-5-methyl-2-amino-; 2-hydroxymethyl-6-methyl-; 2-chloromethyl-6-methyl-; 6-methyl-2-methylthio-; 6-methyl-2-mercapto-; 6-hydroxy-2-methylthio-; 6-methyl-5-benzyl-2-methylthio-; 6-(2-furyl)-2-methylthio-; 6-amino-2-methylthio-; 4,5-pentamethylene-carboxyethyl-2-methylthio-; 5-(2-hydroxyethyl)-2-methylthio-; 5-(2-hydroxypropyl)-2-methylthio-; 6-methylthio-2-isopropylthio-; 2-methylthio-6-ethylthio-5-cyano-; 5-(diethylaminomethyl)-6-methyl-2-methylthio-; 5-piperidinomethyl-6-methyl-2-methylthio- and 6-methyl-2-nitroamino-4-hydroxy-1,3,3a,7-tetrazaindene. Examples of bis-(4-hydroxy-1,3,3a,7-tetrazaindenes) corresponding to formula (V) are 1,2-bis-(4-hydroxy-6-methyl-1,3,3a,7-tetrazainden-2-yle)-1,2-dihydroxyethane; -1,2-ethane; -2,5-dihydroxyhexane; -1,4-butane and 1,2,3,4-tetracis-4-hydroxy-6-methyl-1,3,3a,7-tetrazainden-2-yle-butane. These and other examples, as well as the preparation methods of the 4-hydroxy-1,3,3a,7-tetrazaindenes can be found, for instance, in U.S. Pat. Nos. 2,716,062; 2,852,375; 3,563,755; 2,444,605; 2,444,607; 2,449,225; 3,573,056; 2,566,658; 2,835,581; 2,852,375; 2,756,147; 2,566,659; 3,462,272; 3,565,631; in French Pat. Nos. 1,328,085; 1,365,088 and in British Pat. Nos. 748,750; 805,826 and 1,022,872. Examples of substituted benzotriazole and benzimidazole stabilizers include 5-benzoylamino-benzotriazole; 5-carbetoxyamino-benzotriazole; 4,6-dichloro-benzotriazole; 5,6-dibromo-; 4,6-dibromo-; 4,5,6,7-tetrachloro-benzotriazole; 5-nitrobenzotriazole; naphthotriazole; 5-sulfo-benzimidazole; 5-nitro-benzimidazole; 5-methoxy-benzimidazole, naphthimidazole. These and other benzotriazole and benzimidazole examples can be found, for instance, in Belgian Pat. No. 398,531; in German Pat. No. 617,712; in East German Pat. No. 42,450; in U.S. Pat. No. 3,082,088; in British Pat. No. 443,843; in U.S. Pat. No. 1,606,830.

Illustrative examples of compounds useful to the purposes of the present invention, combined with the aqueous latexes of the hydrophobic vinyl addition polymers in reactive association with the fine-grain and high chloride content emulsions are the following ones.

C 1: 2-methylmercapto-4-hydroxy-5-(β-hydroxyethyl)-6-methyl-1,3,3a,7-tetrazaindene;

C 2: 2-methylmercapto-4-hydroxy-6-methyl-1,3,3a,7-tetrazaindene;

C 3: 4-hydroxy-6-methyl-1,3,3a,7-tetrazaindene;

C 4: Benzotriazole

C 5: Benzimidazole.

Preferably, the fine-grain and high chloride content silver halide emulsions, according to the present invention, have a grain average size lower than 0.15 micron. The term "grain size", as used in the present invention, refers to the diameter of a circle having the area of the same value as the average area projected by the silver halide crystals seen on an electronic microscope.

Still preferably, the fine-grain and high chloride content silver halide emulsions, according to the present invention, have a chloride content higher than 80% moles. In particular, the preferred high chloride content emulsion is a silver chloro-bromide emulsion.

Still preferably, the vinyl addition polymer above is associated with the fine-grain and high chloride content silver halide emulsion in a quantity ranging from 10 to 100 grams per 100 grams of the hydrophilic colloid which makes up the layer containing the silver halide emulsion, more preferably in a quantity ranging from 20 to 50 grams per 100 grams of the hydrophilic colloid. The hydrophilic colloids are those normally used in the photographic art and comprise, for instance, substances which can be found in nature, such as proteins (gelatin and gelatin derivatives), cellulose derivatives, polysaccharides such as dextrane, arabic gum and the like, and polymeric substances obtained upon synthesis such as the water-soluble polyvinyl compounds of the polyvinylpyrrolidone and polyacrylamide type, and the like. The preferred hydrophilic colloid is gelatin and the silver halide emulsion is used in a quantity normally ranging from 0.5 to 1.5 moles, and more specifically from 0.75 to 1.25 moles per 100 grams of gelatin. Still preferably, the stabilizers selected from the group consisting of 4-hydroxy-1,3,3a,7-tetrazaindene, benzotriazole and benzimidazole are associated with the silver halide emulsion in a quantity ranging from $1\times10^{-4}$ to $1\times10^{-1}$ moles per silver mole, more preferably from $1\times10^{-3}$ to $1\times10^{-2}$ moles per silver mole.

According to another aspect, the present invention refers to a method for obtaining a high-contrast half-tone, dot or line, image, wherein a silver halide sensitive material (comprising, coated on a support, one or more hydrophilic colloidal layers, at least one of which is a silver halide emulsion layer), image-wise exposed to form half-tone images, is submitted to a photographic processing comprising an alkaline developing solution, characterized by reactively associating a fine-grain and high chloride content silver halide emulsion in the photosensitive material with an aqueous latex of a hydrophobic vinyl addition polymer in combination with a stabilizer selected from the group consisting of 4-hydroxy-1,3,3a,7-tetrazaindenes, benzotriazoles and benzimidazoles in such a quantity as to increase the contrast of the image obtained after processing.

In particular, the hydrophobic vinyl addition polymers are those deriving from the above described monomers. Still in particular, the 4-hydroxy-1,3,3a,7-tetrazaindenes, the benzotriazoles and the benzimidazoles correspond to the above described compounds. According to the method of the present invention, the nature and the quantity of such vinyl addition polymers and of such compounds to be associated with the emulsion, the emulsion compositions and the silver halide grain sizes are preferably chosen so as to increase the contrast of the photosensitive material after processing. It has been found in particular that the grain sizes and more particularly the chloride content of the silver halide emulsion have an important effect to the above specified purposes. Of course, the man skilled in the art can prepare the emulsion with a silver halide content, grain sizes of the silver halide particles and quantities of the selected compounds in a proper way as to perform the process in the best way according to his particular needs.

In a further aspect, the present invention refers to a half-tone high-contrast, dot or line, photographic image obtained according to the above described method.

When associated with the fine-grain and high chloride content silver halide emulsion of the present invention, the hydrophobic vinyl addition polymers and the compounds selected in the above said group cause a significant increase in the contrast of the image obtained after processing. The term "associated" is used to means added to the coating composition comprising the silver halide emulsion to obtain the silver halide emulsion layer, or (as regards the compouds selected from the group of 4-hydroxy-1,3,3a,7-tetrazaindenes, benzotriazoles and benzimidazoles, only) added to a coating composition not comprising the silver halide emulsion used to obtain a non-light sensitive layer in a ratio of mutual permeability to water with the silver halide emulsion layer. Other advantages, derived from the use of a fine-grain and high chloride content emulsion resulted to be the high covering power (which leads to a photosensitive material having a low silver coverage), the high developability and productivity, the very good dot-etching characteristics.

Other compounds, known in the photographic art, as good silver halide emulsion stabilizers, such as, for instance, adenine and 1-phenyl-5-mercaptotetrazole, did not prove effective to increase the contrast of a fine-grain and high chloride content silver halide emulsion, when combined with the fine particles of the hydrophobic vinyl addition polymer under the form of a latex. Hydrophobic vinyl addition polymers prepared in mass and then dispersed in the photographic layer according to the well-known dispersion technique under the form of particles of about 0.3 micron, as well as hydrosoluble vinyl addition polymers such as water-soluble polyacrylamides and dextranes added to the fine-grain and high chloride content silver halide emulsions in combination with the compounds selected from the above specified classes did not prove effective to increase the contrast of the images after development.

The silver halide emulsions of the present invention have preferably a narrow grain size distribution, but the invention is not limited to such emulsions. As stated previously, the invention refers to very fine grain silver halide emulsion, wherein the highest halide constituent is chloride and the lowest, if present, is bormide or iodide or both. Very fine grain emulsions, as the emulsions of the present invention, are often called "Lippmann Emulsions". The methods of preparation of such emulsions are well-known and are described for example by P. Glafkidés in "Photographic Chemistry", Fountain Press, London, 1958, vol. I, p. 365.

The silver halide emulsions can possibly be sensitized with gold compounds, such as chloroaurates and gold chloride; noble metal salts such as rhodium and iridium, sulfur compounds capable of producing silver sulfide by reacting with the silver salts; and reducing substances such as stannous salts, amines and formamidine sulfinate. Furthermore, during precipitation or physical ripening of the silver halide emulsion, noble metal salts such as rhodium and iridium may also be present. The emulsion binder preferably is gelatin, although a part thereof or all can be replaced with other synthetic or natural polymers as described in Research Disclosure, 1978, 17643, IX, for instance, in order to improve the dimensional stability and the physical properties of the coated film.

The coating compositions can be added with suitable antifoggants or stabilizers, as described for instance in the above mentioned Research Disclosure, under paragraph VI.

The emulsions can furthermore contain additives, as wetting agents, hardeners, filter dyes, plasticizers, lubricants, matting agents, etc., as described in the above mentioned Research Disclosure. Further to the silver halide emulsion layer of the present invention coated on the support, the sensitive material can contain non-light sensitive layers, such as a protective top layer, an antihalo layer, an antistatic layer, etc. Such non-light sensitive layers can contain hydrophilic colloidal binders (e.g. gelatin), surfactant agents, matting agents, slippering agents, gelatin plasticizing agents, a polymeric latex, etc.

Examples of supports preferably used in the photosensitive materials of the present invention include polyester films, such as a polyethyleneterephthalate film and cellulose ester films such as cellulose triacetate.

The present invention does not put any particular restriction on the developing process of the photosensitive material. In general, any developing process can be adopted (comprising the developing, fixing and etching steps) which is used to process conventional photographic materials to be used in the lithographic field. Such developing process can be performed manually or by using automatic processors, at a processing temperature generally ranging from 18° to 50° C., but also outside such a range.

The developing solution can contain any known developing agent. Examples of developing agents (which can be used alone or in mixture) compride the dihydroxybenzenes (e.g. hydroquinone), aminophenols (e.g. N-methyl-p-aminophenol), 3-pyrazolidones (e.g. 1-phenyl-3-pyrazolidone), ascorbic acid, etc. Moreover, such developing solutions can contain preservatives, alkali agents, buffering agents, antifoggants, water softening agents, hardeners, etc. A developing solution which can be used in the present invention is the so-called lith developing solution which comprises a dihydroxybenzene developing agent, an alkali agent, a small quantity of free sulfite and a buffering agent for the sulfite ions (such as formaline and sodium bisulfite adducts and acetone and sodium bisulfite adducts) to monitor the free sulfite concentration, etc.

The fixing solution can have any conventional composition. Examples of fixing agents which can be used comprise thiosulfates, thiocyanates and sulfur organic compounds, known as fixing agents. The fixing solution can further contain water-soluble alluminium salts as hardeners.

The etching solution can also have any conventional composition and for instance the compositions described by C. E. K. Mees in "The Theory Of The Photographic Process", McMillan, 1954, p. 737 to 744 and precisely an etching solution can be used which as a reducing agent comprises a permanganate, a ferric salt, a persulfate, a cupric acid, a ceric acid, a hexacyanoferate-(III) or a dichromate, alone or in combination and, possibly, an inorganic acid such as sulfuric acid, and an alcohol; or an etching solution can be used which comprises a reducing agent such as a hexacyanferate-(III), ethylenediaminotetracetatoferate-(III) or the like and a silver halide solvent such as thiosulfate, thiocyanate, thiourea or a derivative thereof and, possibly, an inorganic acid such as sulfuric acid. Representative examples of etching solutions are Farmer's solutions comprising potassium ferrocyanide and sodium thiosulfate, an etching solution comprising a potassium persulfate and permanganate, an etching solution comprising persulfate, an etching solution comprising a ceric salt, etc.

The present invention is now illustrated with more details by making reference to the following examples.

EXAMPLE 1

A silver halide emulsion containing 98% mole chloride and 2% mole bromide was prepared by adding 800 ml of a 2,5N silver nitrate water solution and a mixed halide water solution, comprising 17 ml of 2,5N potassium bromide and 833 ml of 2,5N potassium chloride and comprising 0.34 micromole $Rh^{+++}$ salt, to a gelatin water solution at 36° C. in 30 minutes under stirring according to the conventional double jet technique.

The emulsion was coagulated by reducing pH to 3.5 and adding 800 ml of a 40% w/v sodium sulfate water solution. The emulsion was washed in the conventional way and reconstituted by adding an additional quantity of gelatin to give a final content of 80 g of gelatin per silver mole.

The average size of the emulsion grains was measured under the electronic microscope and resulted to be 0.20 micron. The emulsion was divided into four equal parts and each part was added with a hardener (formaldehyde) and a surfactant. Each part was then added with other additions as shown in Table 1. Every emulsion part, with the described additions, was then coated at a silver coverage of 2.5 g/m$^2$ onto a polyester support provided with an antihalation green backing layer, thus obtaining four lithographic films respectively. Each film was exposed to a quarz-iodine 650 W lamp at a distance of 1 meter for 10 seconds through a K 0.15 wedge. Each exposed film was developed in a 3M RDC developer for 20 seconds at 40° C. and fixed in a 3M Fixroll fixer.

The following sensitometric characteristics were measured on H and D curve by using a densitometer:

(a) SENS., which is 1 g 20/E (where E is the exposures in lux/seconds) corresponding to a density of 0.20 above fog;

(b) TOE$\gamma$, which is the absolute value of the slope of the line joining the points at density 0.17 and 0.37 above fog;

(c) TOTAL $\gamma$, which is the absolute value of the slope of the line joining the points at density 0.1 and 4.0 above fog.

Table 1 reports the sensitometric characteristics.

TABLE 1

| Film | PL-3 g/100 g gel | C 1 M/AgM | SENS. | TOE $\gamma$ | TOTAL $\gamma$ |
|---|---|---|---|---|---|
| 1a | — | — | 2.40 | 1.60 | 7.5 |
| 1b | 30 | — | 2.45 | 1.54 | 7.5 |
| 1c | — | $3.75 \times 10^{-3}$ | 2.37 | 1.53 | 7.5 |
| 1d | 30 | $3.75 \times 10^{-3}$ | 2.24 | 1.76 | 8.3 |

EXAMPLE 2

A silver halide emulsion containing 64% mole chloride and 36% mole bromide was prepared by following the procedure described in Example 1, varying the ratio of the halide solutions and containing 7 micromole $Rh^{+++}$ salt per silver mole. The emulsion was coagulated and washed as described in Example 1 and at the examination at the electronic microscope resulted to have an average grain size of 0.20 micron.

The emulsion was divided into four equal parts, each part was added with formaline and the surfactant. Each part was then added with the other additions as shown in Table 2. Each part was coated onto a base as described in Example 1. The resulting films were exposed and processed as described in Example 1.

Table 2 reports the sensitometric characteristics.

TABLE 2

| Film | PL-3 g/100 g gel | C 1 M/AgM | SENS. | TOE $\gamma$ | TOTAL $\gamma$ |
|---|---|---|---|---|---|
| 2a | — | — | 2.03 | 1.67 | 8.0 |
| 2b | 20 | — | 2.03 | 1.47 | 7.5 |
| 2c | — | $3.75 \times 10^{-3}$ | 1.77 | 1.50 | 8.0 |
| 2d | 20 | $3.75 \times 10^{-3}$ | 1.82 | 1.71 | 8.5 |

EXAMPLE 3

A silver halide emulsion containing 98% mole chloride, 2% mole bromide and 2.1 micromole $Rh^{+++}$ salt per silver mole was prepared as described in Example 1. The silver halide grain average sizes were reduced to 0.09 micron by using the techniques known in the art of varying the temperature, the precipitation time and the solution concentrations. The emulsion, washed and frozen, was divided into six equal parts; each part was added with the formaline, with the surfactant and with the additions shown in Table 3. The films obtained by coating every part onto the base were exposed and processed as described in Example 1.

Table 3 reports the sensitometric characteristics.

TABLE 3

| Film | PL | PL g/100 g gelatin | C 1 M/AgM | SENS. | TOE $\gamma$ | TOTAL $\gamma$ |
|---|---|---|---|---|---|---|
| 3a | — | — | $3.75 \times 10^{-3}$ | 1.94 | 0.89 | 6.6 |
| 3b | PL-1 | 30 | " | 1.49 | 1.49 | 8.3 |
| 3c | PL-2 | 30 | " | 1.83 | 1.49 | 8.1 |
| 3d | PL-3 | 30 | " | 1.85 | 1.47 | 7.7 |
| 3e | A(1) | 30 | " | 1.98 | 0.87 | 6.6 |
| 3f | B(2) | 30 | " | 2.07 | 0.82 | 5.7 |

(1)Polyurethane latex sold by Montedison under the name of PA 548.
(2)Polyurethane latex sold by Onyx under the name of LATEX PU 280 A.

EXAMPLE 4

The emulsion described in Example 3 was divided into four equal parts and each was added with the formaldehyde and with the surfactant as described in Example 3 and with the further additions as shown in Table 4. The films obtained by coating every part onto the support were exposed and processed as described in Example 1.

Table 4 reports the sensitometric characteristics.

TABLE 4

| Film | PL-3 g/100 g gel | C 1 M/AgM | SENS. | TOE γ | TOTAL γ |
|---|---|---|---|---|---|
| 4a | — | $3.75 \times 10^{-3}$ | 1.97 | 0.92 | 4.8 |
| 4b | 15 | " | 1.89 | 1.01 | 5.8 |
| 4c | 30 | " | 1.81 | 1.42 | 6.5 |
| 4d | 45 | " | 1.77 | 1.58 | 7.5 |

EXAMPLE 5

The emulsion described in Example 3 was divided into eight equal parts and each part was added with the formaline, with the surfactant and with the further additions as shown in Table 5. The films obtained by coating every part onto the support (always at a silver coverage of 2.5 g/m$^2$) were exposed and processed as described in Example 1.

Table 5 reports the sensitometric characteristics.

TABLE 5

| Film | PL | PL g/100 g gelatine | C 1 M/AgM | SENS. | TOE γ | TOTAL γ |
|---|---|---|---|---|---|---|
| 5a | — | — | $3.75 \times 10^{-3}$ | 2.03 | 1.10 | 7.2 |
| 5b | PL-3 | 30 | " | 1.85 | 1.35 | 8.7 |
| 5c | PL-7 | 30 | " | 1.79 | 1.42 | 8.9 |
| 5d | PL-8 | 30 | " | 1.70 | 1.42 | 8.5 |
| 5e | C(1) | 30 | " | 2.00 | 0.99 | 7.0 |
| 5f | D(2) | 30 | " | 2.04 | 1.10 | 7.2 |
| 5g | E(3) | 30 | " | 1.97 | 0.93 | 6.6 |
| 5h | F(4) | 30 | " | 1.95 | 0.91 | 6.1 |

(1)Water-soluble co-polymer (acrylamide-ethylacrylate) (75/25).
(2)Water-soluble 40,000 molecular weight dextrane.
(3)Polymethylmethacrylate dispersion obtained by dissolving the polymer in ethyl acetate and then dispersing the solution in a gelatin water solution containing a surfactant such as to obtain particles having a mean diameter of 0.3 micron.
(4)Tricresylphosphate dispersion obtained by dissolving the compound in ethyl acetate and then dispersing the solution in a gelatin water solution containing a surfactant such as to obtain particles having a mean diameter of 0.3 micron.

EXAMPLE 6

The emulsion described in Example 3 was divided into six equal parts and each part was added with formaldehyde, a surfactant and with the further additions as shown in Table 6. The films obtained by coating each part onto a base at a silver coverage of 2.5 g/m$^2$ were exposed and processed as described in Example 1.

Table 6 reports the sensitometric characteristics.

TABLE 6

| Film | PL | PL g/100 g gelatine | C 1 M/AgM | SENS. | TOE γ | TOTAL γ |
|---|---|---|---|---|---|---|
| 6a | — | — | $3.75 \times 10^{-3}$ | 2.00 | 1.08 | 6.4 |
| 6b | PL-1 | 30 | " | 1.76 | 1.50 | 9.2 |
| 6c | PL-3 | 30 | " | 1.80 | 1.44 | 9.3 |
| 6d | PL-4 | 30 | " | 1.85 | 1.35 | 8.9 |
| 6e | PL-5 | 30 | " | 1.83 | 1.33 | 8.6 |
| 6f | PL-6 | 30 | " | 1.85 | 1.42 | 8.9 |

EXAMPLE 7

A series of silver halide emulsions was prepared by varying the chloride-bromide ratio in a process like that described in Example 1. The emulsions had mean particle sizes of 0.10 micron. Each emulsion was added with formaline, with the surfactant and with the further additions as shown in Table 7. Each emulsion was coated at a silver coverage of 2.5 g/m$^2$ onto a polyester support provided with a green backing antihalation layer. The films obtained were exposed and processed as described in Example 1.

Table 7 reports the sensitometric characteristics.

TABLE 7

| Film | Emuls. Cl:Br ratio | PL-3 g/100 g gelatine | C 1 M/AgM | SENS. | TOE γ | TOTAL γ |
|---|---|---|---|---|---|---|
| 7a | 100:0 | — | $3.75 \times 10^{-3}$ | 2.93 | 1.20 | 12.0 |
| 7b | 100:0 | 30 | " | 2.76 | 1.40 | 13.5 |
| 7c | 75:25 | — | " | 2.67 | 1.15 | 8.1 |
| 7d | 75:25 | 30 | " | 2.60 | 1.30 | 8.7 |
| 7e | 50:50 | — | " | 2.19 | 1.00 | 5.0 |
| 7f | 50:50 | 30 | " | 2.20 | 0.95 | 4.9 |
| 7g | 25:75 | — | " | 1.40 | 0.74 | NV(*) |
| 7h | 25:75 | 30 | " | 1.38 | 0.57 | NV(*) |
| 7i | 0:100 | — | " | 0.86 | 0.59 | NV(*) |
| 7l | 0:100 | 30 | " | 0.80 | 0.51 | NV(*) |

(*)NV = Not evaluable because too low.

EXAMPLE 8

A series of silver halide emulsions, having different mean sizes of the silver halide particles was prepared with the double-jet technique as described in Example 1. The emulsions contained 98% mole chloride and 2% mole bromide. The silver halide particle sizes were monitored by using the techniques well-known in the art of varying the temperature, the precipitation time and the solution concentrations. Each emulsion was added with formaldehyde, with a surfactant and with the further additions as shown in Table 8. Each emulsion was coated at the silver coverage of 2.5 g/m$^2$ onto a polyester base provided with a green backing antihalation layer. The obtained films were exposed and processed as described in Example 1.

Table 8 reports the sensitometric characteristics.

TABLE 8

| Film | Particle mean sizes μ | PL-3 g/100 g gelatine | C 1 M/AgM | SENS. | TOE γ | TOTAL γ |
|---|---|---|---|---|---|---|
| 8a | 0.08 | — | $3.75 \times 10^{-3}$ | 1.88 | 1.00 | 6.4 |
| 8b | 0.08 | 30 | " | 1.70 | 1.30 | 7.4 |
| 8c | 0.11 | — | " | 1.90 | 1.00 | 6.5 |
| 8d | 0.11 | 30 | " | 1.75 | 1.30 | 7.2 |
| 8e | 0.16 | — | " | 1.95 | 1.15 | 6.8 |
| 8f | 0.16 | 30 | " | 1.75 | 1.30 | 7.0 |

EXAMPLE 9

A silver halide emulsion containing 98% mole chloride and 2% mole bromide, having mean silver halide grain sizes of 0.8 micron, was prepared as described in Example 3. A similar emulsion was prepared without the addition of the Rh+++ salt. Each emulsion was divided into two equal parts and each was added with formaldehyde, with a surfactant and with the further addition as shown in Table 9. Each part was coated with a silver coverage of 2.5 g/m$^2$ onto a polyester base provided with a green backing antihalation layer. The obtained films were exposed and processed as described in Example 1.

Table 9 reports the sensitometric characteristics.

TABLE 9

| Film | $Rh^{+++}$ salt μM/AgM | PL-3 g/100 g gelatine | C 1 M/AgM | SENS. | TOE γ | TOT. γ |
|---|---|---|---|---|---|---|
| 9a | — | — | $3.75 \times 10^{-3}$ | 2.35 | 0.64 | 4.7 |
| 9b | — | 30 | 3 | 2.30 | 0.84 | 5.0 |
| 9c | 2.1 | — | 3 | 2.10 | 1.13 | 6.0 |
| 9d | 2.1 | 30 | " | 2.00 | 1.25 | 7.0 |

EXAMPLE 10

A silver halide emulsion containing 98% mole chloride and 2% mole bromide, having silver halide mean grain sizes of 0.10 micron, was prepared as described in Example 3. The emulsion was divided into 11 equal parts and each part was added with formaldehyde, of a surfactant and with the further additions as shown in Table 10. Each emulsion part was coated with a silver coverage of 2.5 g/m$^2$ onto a polyester base provided with a green backing antihalation layer. The obtained films were exposed and processed as described in Example 1.

Table 10 reports the sensitometric characteristics.

TABLE 10

| Film | PL-3 g/100 g gelatine | C | M/AgM | SENS. | TOE γ | TOT. γ |
|---|---|---|---|---|---|---|
| 10a | — | — | — | 2.20 | 1.54 | 14 |
| 10b | — | 1 | $3.75 \times 10^{-3}$ | 2.17 | 1.35 | 11.5 |
| 10c | 30 | 1 | $3.75 \times 10^{-3}$ | 2.10 | 1.54 | 14 |
| 10d | — | 2 | $3.57 \times 10^{-3}$ | 2.15 | 1.50 | 12 |
| 10e | 30 | 2 | $3.57 \times 10^{-3}$ | 2.10 | 1.60 | 13 |
| 10f | — | 3 | $4.05 \times 10^{-3}$ | 2.10 | 1.35 | 10 |
| 10g | 30 | 3 | $4.05 \times 10^{-3}$ | 2.05 | 1.45 | 11 |
| 10h | — | 4 | $8.4 \times 10^{-3}$ | 2.10 | 1.27 | 13.5 |
| 10i | 30 | 4 | $8.4 \times 10^{-3}$ | 2.00 | 1.50 | 14.5 |
| 10l | — | 5 | $8.4 \times 10^{-3}$ | 2.10 | 1.30 | 11.5 |
| 10m | 30 | 5 | $8.4 \times 10^{-3}$ | 2.05 | 1.50 | 13 |

We claim:

1. A silver halide photosensitive material for obtaining black-and-white half-tone dot or line images, comprising coated on a support one or more hydrophilic colloidal layers, characterized by the fact that at least one of them includes a high-chloride fine grain silver halide emulsion wherein said silver halide has an average grain size less than or equal to 0.15 micron containing with a vinyl addition hydrophobic polymer latex in combination with a stabilizer selected from the group consisting of 4-hydroxy-1,3,3a,7-tetrazaindenes, benzotriazoles and benzimidazoles.

2. Method for obtaining a black-and-white high contrast half-tone line or dot image, wherein a silver halide photosensitive material, is image-wise exposed for forming half-tone images and subjected to a photographic process comprising an alkaline developing solution, characterized by the fact that said silver halide photosensitive material includes a high-chloride fine-grain silver halide emulsion wherein said silver halide has an average grain size less than or equal to 0.15 micron a vinyl addition hydrophobic polymer latex in combination with a stabilizer selected in the group consisting of 4-hydroxy-1,3,3a,7-tetrazaindenes, benzotriazoles and benzimidazoles.

3. The silver halide photosensitive material as claimed in claim 1, wherein the silver halide is silver chloro-bromide containing at least 80% mole chloride.

4. The silver halide photosensitive material as claimed in claim 1, wherein the vinyl addition polymer is comprised of repeating units derived from at least one of:

(a) ethenic monomers of formula:

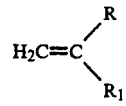

wherein R is hydrogen, halogen or vinyl and $R_1$ is hydrogen, halogen or methyl or, when R is hydrogen, a cyano group;

(b) styrene-type monomers of formula:

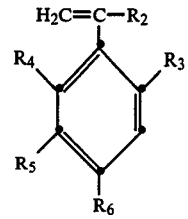

wherein $R_2$ is hydrogen or methyl, $R_3$, $R_4$ and $R_6$ are hydrogen or a lower alkyl of from 1 to 5 carbon atoms, $R_5$ is hydrogen or with $R_4$ constitutes the atoms necessary to complete a fused benzene ring or one of $R_5$ and $R_6$ is halomethyl;

(c) esters of 2-alkenoic acids of formula:

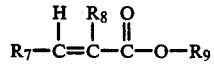

wherein $R_7$ is hydrogen or a lower alkyl of from 1 to 5 carbon atoms, $R_8$ is hydrogen, halogen or a lower alkyl of from 1 to 5 carbon atoms, $R_9$ is alkyl or haloalkyl having from 1 to 20 carbon atoms; and (d) vinyl acetate.

5. The silver halide photosensitive material as claimed in claim 1, wherein the vinyl addition polymer is comprised of repeating units derived from at least one of esters of 2-alkenoic acids having the formula:

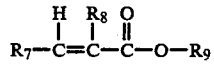

wherein $R_7$ is hydrogen or a lower alkyl of from 1 to 5 carbon atoms, $R_8$ is hydrogen, halogen or a lower alkyl of from 1 to 5 carbon atoms, $R_9$ is alkyl or haloalkyl having from 1 to 20 carbon atoms.

6. The silver halide photosensitive material as claimed in claim 1, wherein the 4-hydroxy-1,3,3a,7-tetrazaindenes correspond to the formula:

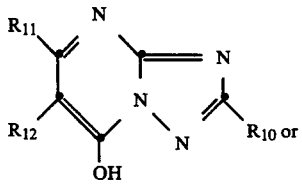

-continued

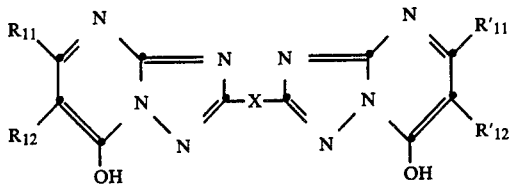

wherein $R_{10}$ is hydrogen, alkyl, hydroxyalkyl, haloalkyl, aryl, alkylthio, amino, nitroamino, mercapto, carboxy or carboalkoxy, $R_{11}$ and $R'_{11}$ are each hydrogen, alkyl, aryl, or alkylthio, $R_{12}$ and $R'_{12}$ are each hydrogen, alkyl, hydroxyalkyl, alkylamino, aryl, halogen or cyano, or $R_{11}$ and $R_{12}$ and/or $R'_{11}$ and $R'_{12}$ form a part of a 5- or 6-membered alicyclic or heterocyclic ring, and X is a bivalent organic group.

7. The silver halide photosensitive material as claimed in claim 1, characterized by the fact that the vinyl addition polymer is associated to the high-chloride fine-grain silver halide emulsion in quantities ranging from 10 to 100 grams per 100 grams of the hydrophilic colloid.

8. The silver halide photosensitive material as claimed in claim 1, characterized by the fact that the stabilizer selected from the group consisting of 4-hydroxy-1,3,3a,7-tetrazaindenes, benzotriazoles and benzimidazoles is associated to the silver halide emulsion in quantities ranging from $1\times10^{-4}$ to $1\times10^{-1}$ moles per mole of silver.

9. The photosensitive material of claim 1 wherein polymer particles in said latex have a mean diameter of from 0.02 to 0.08 micron.

10. The photosensitive material of claim 3 wherein polymer particles in said latex have a mean diameter of from 0.02 to 0.08 micron.

11. The photosensitive material of claim 5 wherein polymer particles in said latex have a mean diameter of from 0.02 to 0.08 micron.

12. The photosensitive material of claim 6 wherein polymer particles in said latex have a mean diameter of from 0.02 to 0.08 micron.

* * * * *